US005172536A

United States Patent [19]

Miyahara

[11] Patent Number: 5,172,536

[45] Date of Patent: Dec. 22, 1992

[54] CONTINUOUS PACKING APPARATUS

[75] Inventor: Takakazu Miyahara, Kaseda, Japan

[73] Assignee: Elm Co., Ltd., Kaseda, Japan

[21] Appl. No.: 798,909

[22] Filed: Nov. 27, 1991

[30] Foreign Application Priority Data

Nov. 30, 1990 [JP] Japan ..... 2-339931

[51] Int. Cl.[5] ..... B65B 9/14

[52] U.S. Cl. ..... 53/567; 53/459

[58] Field of Search ..... 53/459, 567, 577, 564

[56] References Cited

U.S. PATENT DOCUMENTS

| | | | |
|---|---|---|---|
| 2,847,806 | 8/1958 | Wang | 53/567 X |
| 3,070,927 | 1/1963 | Lundahl | 53/567 X |
| 3,812,642 | 5/1974 | Mintz | 53/567 X |
| 4,947,625 | 8/1990 | Zike | 53/567 |

FOREIGN PATENT DOCUMENTS

| | | | |
|---|---|---|---|
| 2517214 | 10/1976 | Fed. Rep. of Germany . | |
| 2807769 | 8/1979 | Fed. Rep. of Germany | 53/567 |
| 6293 | 1/1977 | Japan | 53/567 |
| 56689 | 5/1977 | Japan | 53/567 |
| 64385 | 5/1977 | Japan | 53/567 |

*Primary Examiner*—John Sipos

*Attorney, Agent, or Firm*—Cohen, Pontani, Lieberman, Pavane

[57] ABSTRACT

A continuous packing apparatus providing a cylindrical net supply source for supplying a cylindrical long packing net, an inner sliding member to be inserted in the cylindrical net so as to be vertically moved, a support member for externally supporting the inner sliding member through the cylindrical net with the inner sliding member inserted in the cylindrical net, a moving member for lifting up the support member, an upper support member for supporting the upper end of the cylindrical net moved upward with being opened, a stator for removably fixing the middle portion of the cylindrical net moved upward, a cutter for vertically cutting a portion just under a fixing position, a heater for heating and melting an upper cut portion so as to form a net bag, and a hopper for putting goods to be packed into the net bag through the opening of its upper end.

5 Claims, 8 Drawing Sheets

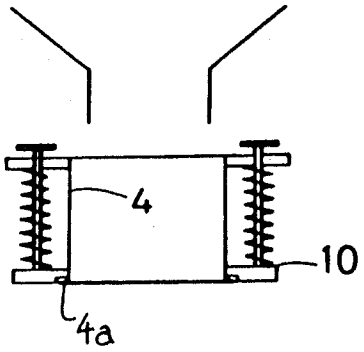
FIG. 7
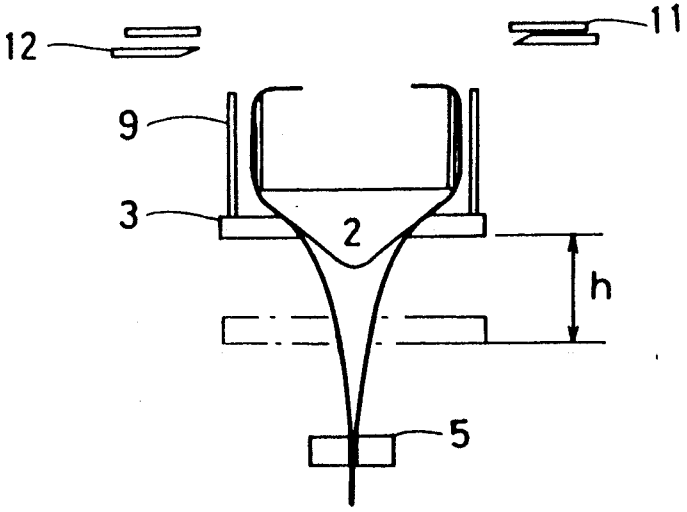
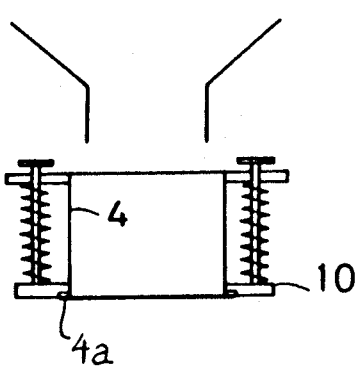
FIG. 6
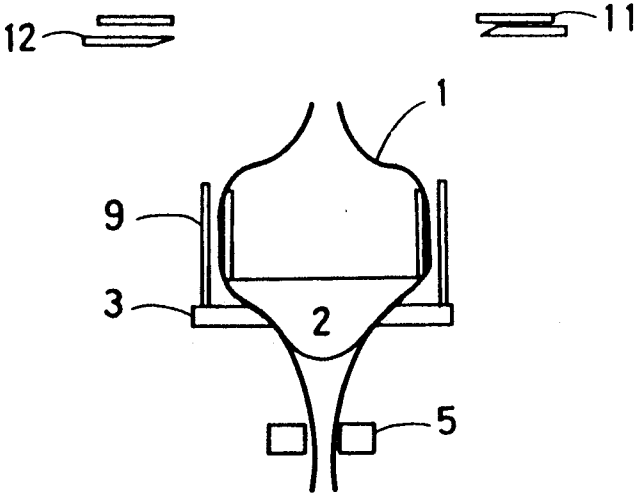

CONTINUOUS PACKING APPARATUS

BACKGROUND OF THE INVENTION

1. Field of the Invention

The present invention relates to a continuous packing apparatus.

2. Description of the Prior Art

In the case where confectionery, fruit and the like are put into a net bag for sale, it is difficult to expand the aperture of the net bag so as to put them thereinto. Consequently, there have been invented various means. However, there has not been proposed a method of performing packing continuously, automatically and efficiently.

Conventionally, there has been adopted a step of expanding the inlet of a cylindrical long packing net 1 such that goods 16 to be packed can easily be put thereinto. In addition, there has been adopted a step of cutting the cylindrical long packing net 1 to have a constant length and closing its bottom by means of an adhesive or the like before the goods 16 to be packed are put into the cylindrical long packing net 1. Consequently, efficiency is decreased significantly.

It is an object of the present invention to provide a continuous packing apparatus in which the above-mentioned steps can be carried out automatically, reliably and continuously.

SUMMARY OF THE INVENTION

The present invention provides a continuous packing apparatus comprising a cylindrical net supply source for supplying a cylindrical long packing net, cylindrical net moving means for externally supporting the cylindrical net supplied from the cylindrical net supply source, and for moving the same upward, an upper support member for supporting the upper end of the cylindrical net while being opened, net bag forming means for removably fixing the middle portion of the cylindrical net moved upward, vertically cutting a portion just under a fixing position and blocking an upper cut portion so as to form a net bag, and a hopper for putting goods to be packed into the net bag through the opening of its upper end, wherein the cylindrical net moving means includes an inner sliding member to be inserted in the cylindrical net so as to be vertically moved, a support member for externally supporting the inner sliding member through the cylindrical net with the inner sliding member inserted in the cylindrical net, and a moving member for lifting up the support member.

According to the present invention, the inner sliding member inserted in the cylindrical net is combined and interlocked with the outer support member, so that the cylindrical net can easily be supported and moved. Consequently, a series of packing operations can be performed.

No particular restrictions are imposed on the shape of the inner sliding member. It is sufficient that the inner sliding member may be formed so as to be vertically moved through the cylindrical net while expanding the same. Preferred examples of the shape of the inner sliding member include a cylinder integrated with a cone, the combinations of a cylinder and a hemisphere, a square pole and a square cone (of which corners are rounded off, for example, a square or rectangle), an elliptic cylinder and an elliptic cone, an elliptic cylinder and a semiellipse, a polygonal cylinder and a polygonal cone (of which corners are rounded off, for example, a regular or irregular polygonal cylinder). and the like.

The inner sliding member is inserted in the cylindrical net and is vertically moved in the cylindrical net correspondingly to each step of the packing operations. In this case, the inner sliding member is directly or indirectly supported by the support member through the cylindrical net externally. By way of example, the inner sliding member may directly be supported and lifted up through the cylindrical net by the support member (with which the inner sliding member comes in contact), and may then fall down by self-respect. Furthermore, the inner sliding member may indirectly be moved vertically by a magnetic force to be applied to the support member (with which the inner sliding member does not come in contact). In addition, the inner sliding member may directly be moved vertically through the cylindrical net by a roller as the support member (with which the inner sliding member comes in contact).

BRIEF DESCRIPTION OF THE DRAWINGS

FIGS. 6 to 15 are views showing the operation sequence of 1st to 10th steps.

PREFERRED EMBODIMENT

Figure 2:
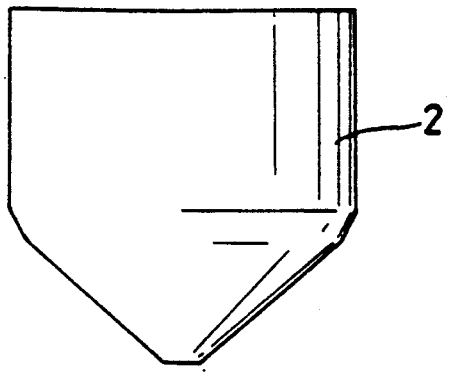
FIG. 2 is a front view of an inner sliding member.
Figure 3:
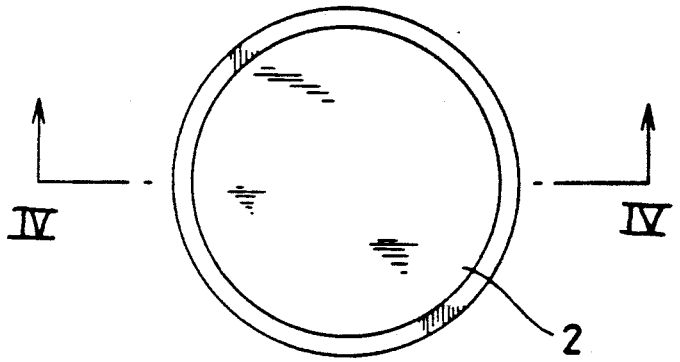
FIG. 3 is a plan view of the inner sliding member.
Figure 4:
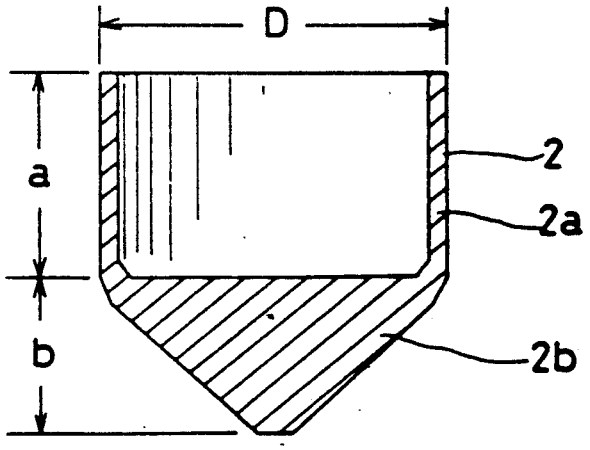
FIG. 4 is a section view of the inner sliding member taken along the line IV—IV shown in FIG. 3.
Figure 5:
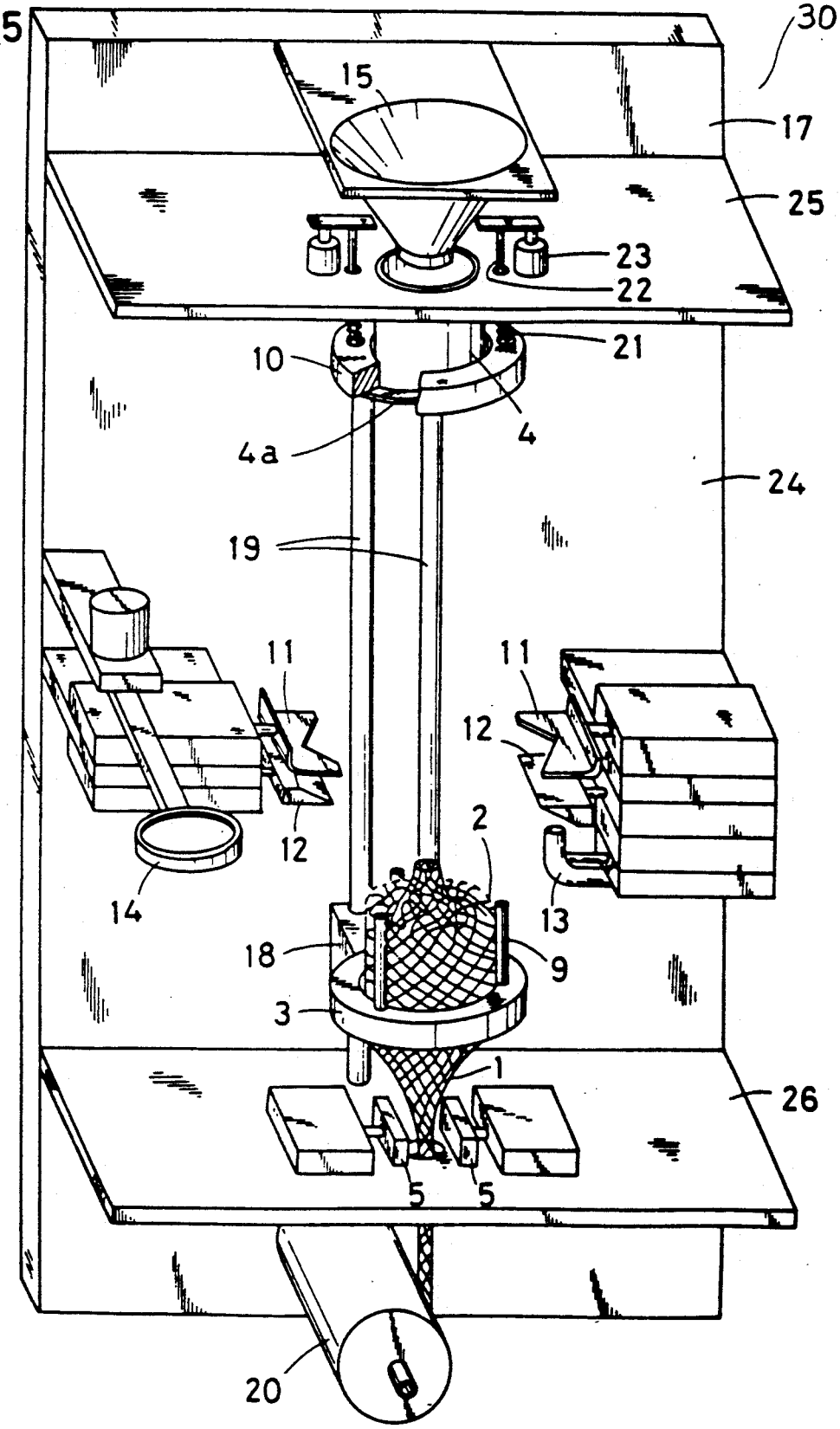
FIG. 5 is a view for explaining the entire structure of an operating device.

There are used an inner sliding member 2 having a smooth outer face shown in FIGS. 2 to 4 and an operating device 17 shown in FIG. 5 as a continuous packing apparatus 30 for performing continuous packing by means of a cylindrical long packing net 1.

Figure 1:
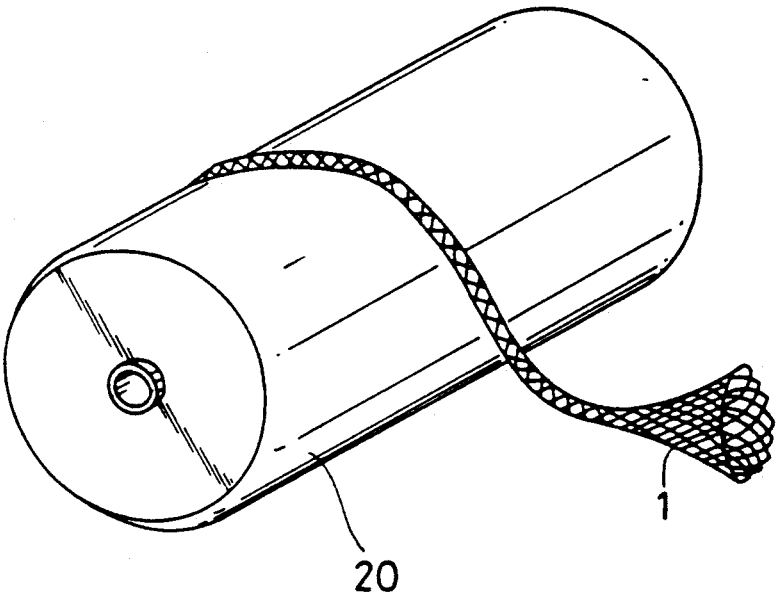
FIG. 1 is a view for explaining the winding of a cylindrical long packing net.

As shown in FIG. 1, the cylindrical long packing net 1 is supplied in the form of a thick string wound onto a roll 20.

It is necessary to extend the string so as to have the shape of the cylindrical long packing net 1.

It is required that the cylindrical long packing net 1 like a string is supplied from the lower roll 20 and is continuously pulled up to expand its aperture such that goods (confectionery) 16 to be packed can easily be put thereinto.

The operating device 17 shown in FIG. 5 mainly comprises a ring-shaped support fitting 3, an elevator (with a built-in servomotor or air cylinder) 18 for causing the support fitting 3 to go up and down, a rail 19, a ring-shaped upper fitting 10, a holder 4 for pressing and supporting the cylindrical long packing net 1 together with the upper fitting 10 with the aperture of the Cylindrical long packing net 1 expanded, a hopper 15 coaxially provided on the top of the holder 4, a clamp 5, a clamp 11, a cutter 12, a heat source 13, and a saucer 14. The reference numeral 9 denotes a force pin erected on the support fitting 3. The reference numeral **4*a* denotes a flange of the holder 4 for pressing the aperture of the cylindrical long packing net 1 together with the upper fitting 10. The reference numeral 21 denotes a coil spring. The reference numeral 22 denotes a support shaft of the coil spring 21. The reference numeral 23 denotes a cylinder. The reference numeral 24 denotes a basic wall. The reference numeral 25 denotes an upper plate. The reference numeral 26** denotes a lower plate.

The continuous packing apparatus 15 having the above-mentioned structure is operated by the operating device 17 as shown in FIGS. 6 to 15.

As shown in FIG. 6, the cylindrical long packing net 1 supplied from the roll 20 has its aperture slightly expanded by inserting the inner sliding member 2 therein.

As shown in FIG. 7, the inner sliding member (or shuttle) 2 is supported by the support fitting 3 through the cylindrical long packing net 1 externally. The support fitting 3 is pushed up to a constant height h together with the cylindrical long packing net 1 along the rail 19 by means of the elevator 18. In this case, the cylindrical long packing net 1 is fixed by the clamp 5. Thus, before support fitting 3 is pushed up the constant height h, clamp 5 clamps onto cylindrical long packing net 1, thereby drawing or sliding the net down from above supporting fitting 3. The sliding between the cylindrical long packing net 1 and the inner sliding member 2 causes the aperture of the cylindrical long packing net 1 to expand greatly in order to be easily fixed to the holder 4.

Figure 9:
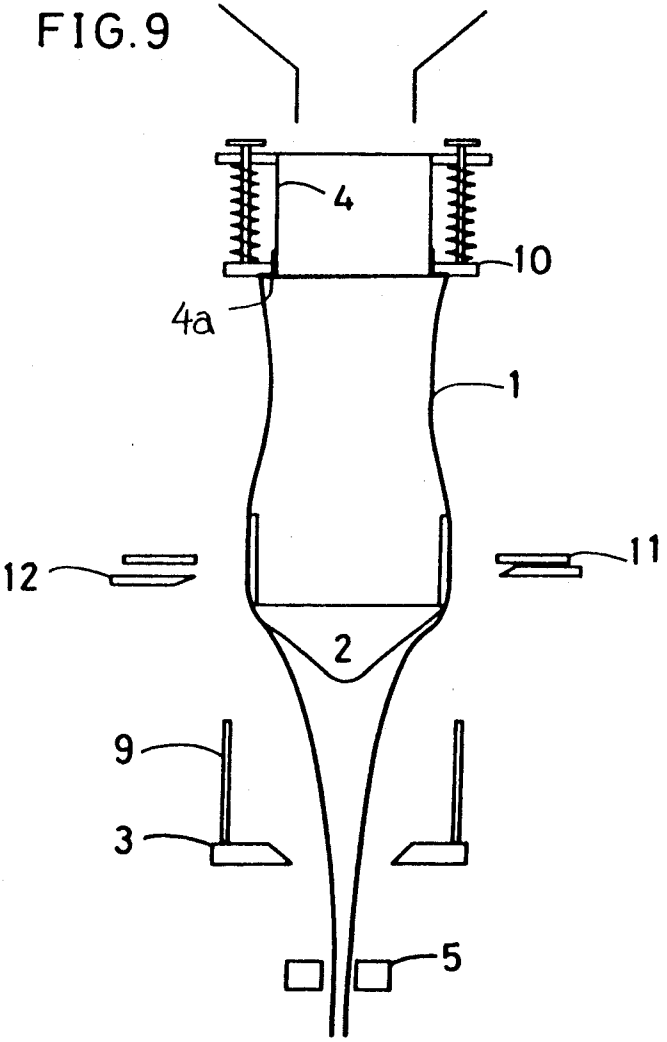
Figure 8:
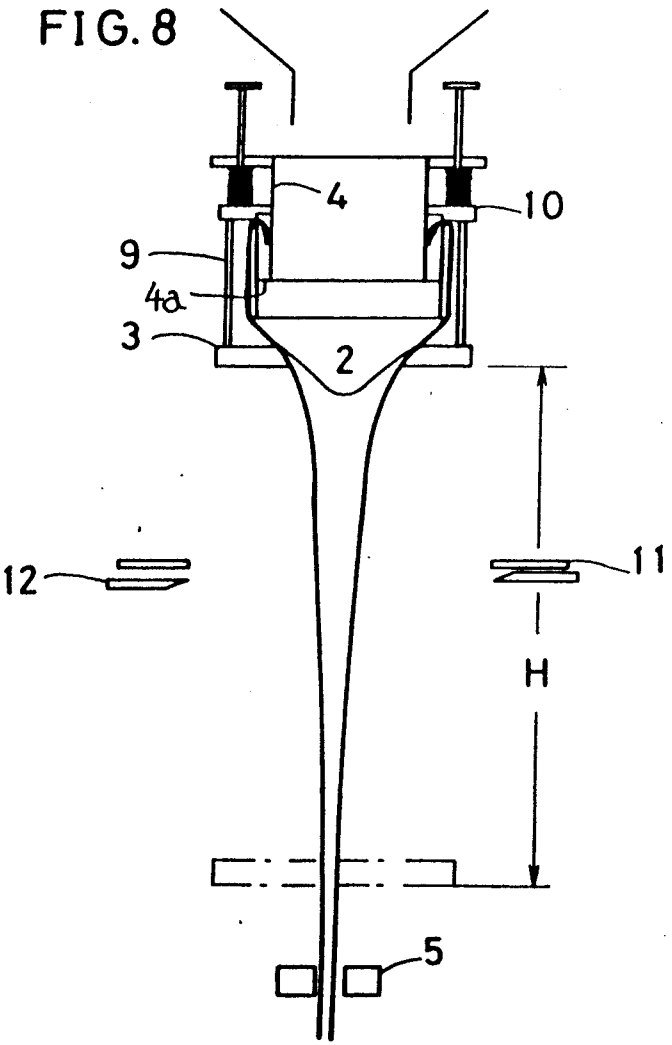
Figure 11:
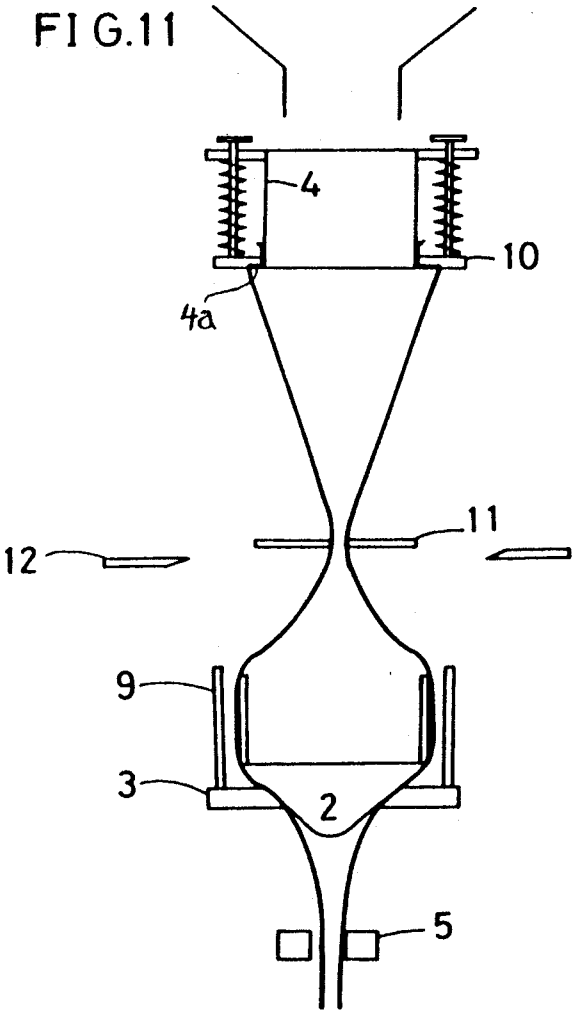
Figure 10:
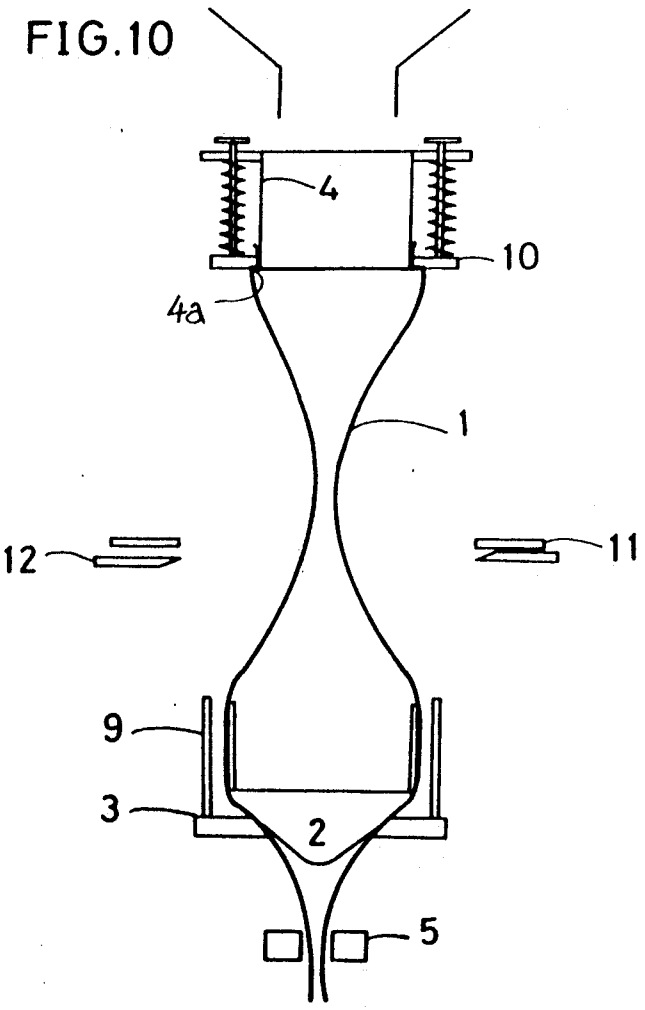
Figure 13:
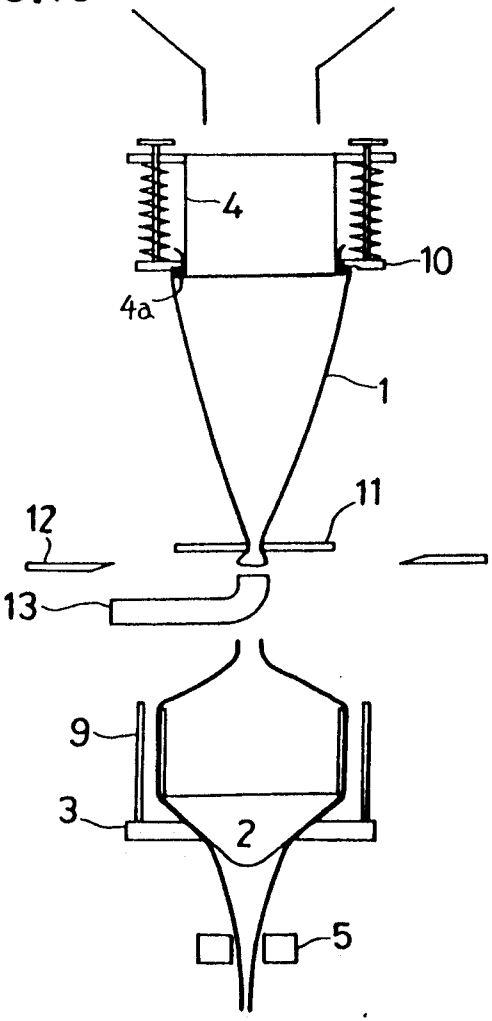

As shown in FIG. 8, the clamp 5 is opened and the cylindrical long packing net 1 having the aperture expanded is pulled up to a height H at which the upper fitting 10 is pushed up. Then, the elevator 18 falls down so that the cylindrical long packing net 1 is interposed between the upper fitting 10 and the holder 4 through which the goods (confectionery) 16 to be packed pass. Thus, as shown FIGS. 7, 8 and 9, when inner sliding member 2 is moved up, holder 4 fits within inner sliding member 2 so that the packing net 1 is pulled up to surround the holder 4, and when the inner sliding member 2 is lowered, the net 1 is trapped between flange 4*a* of holder 4 and upper fitting 10. Thereafter, the inner sliding member 2 slides down through the cylindrical long packing net 1 as shown in FIG. 9, and returns to a position in FIG. 6 as shown in FIG. 10.

Figure 12:
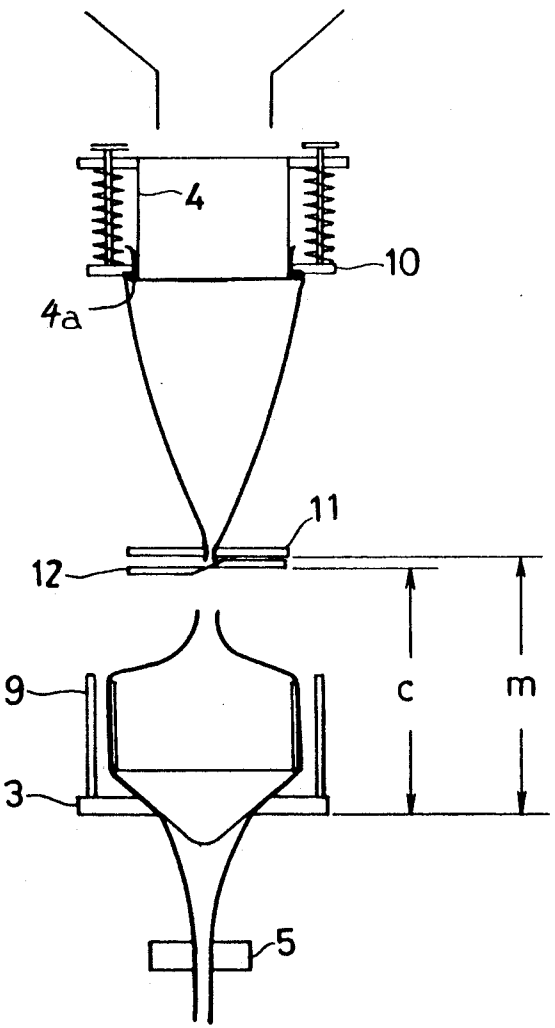
Figure 15:
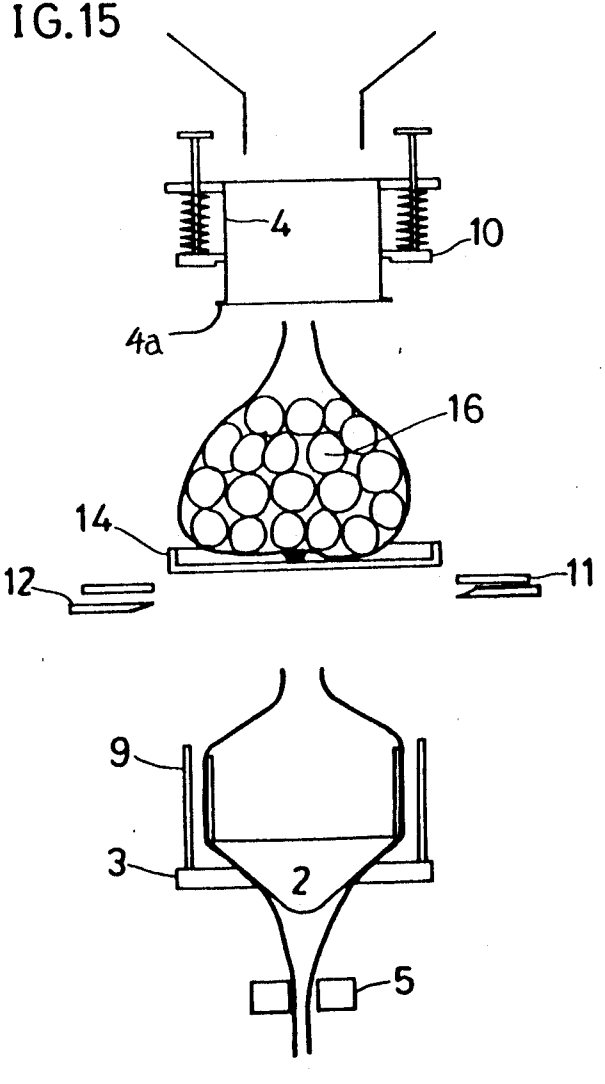
Figure 14:
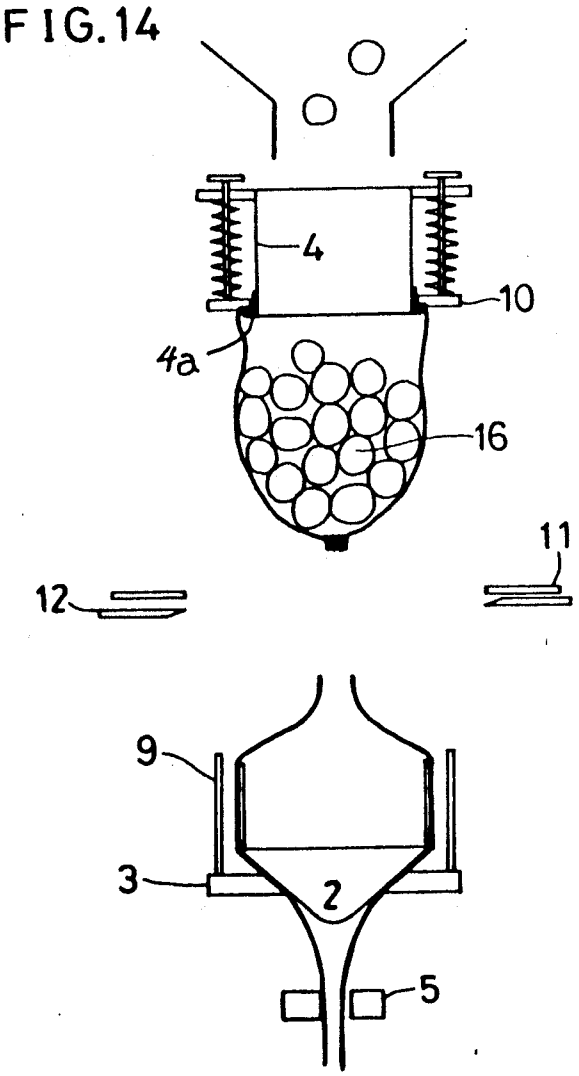

The middle portion of the cylindrical long packing net 1 having no inner sliding member 2 is held by the clamp 11 (FIG. 11), and is then cut by the cutter 12 (FIG. 12). A Cut portion is melted and sealed by the heat source 13. Consequently, the cylindrical long packing net 1 is transformed into a constant slender bag (see FIG. 13). When a given quantity of goods (confectionery) 16 to be packed are put into the cylindrical long packing net 1 through the holder 4 as shown in FIG. 14, the cylindrical long packing net 1 is supported by the saucer 14 transferred in a transverse direction as shown in FIG. 15. In addition, the upper fitting 10 is lifted up by the cylinder 23 through the support shaft 22, so that the cylindrical long packing net 1 is removed from the upper fitting 10. Consequently, the state shown in FIG. 6 is returned.

In order to repeat the steps shown in FIGS. 6 to 15, the goods 16 can also be packed by continuous operations with each means provided on the circumference differently from the operating device shown in FIG. 5.

According to the present invention, the goods 16 can be packed by the cylindrical long packing net 1 with the use of the inner sliding member 2 automatically, continuously and very quickly.

For reference, specific examples of the dimensions and materials of the packing apparatus, the packing net and the like are as follows. It is necessary to change the following dimensions according to the sizes of the net and goods to be packed.

i) Inner sliding member 2 (see FIG. 4)
Same diameter portion a:6.5 cm
Slanting portion b:8.0 cm
Diameter D:13.0 cm
Material:Al (NiP treatment)

ii) Packing net 1 (see FIG. 1)
Strand size:6 mm
Mesh:5 mm×5 mm
Overall size in a natural state:about 20 cm $\phi$
Material:Polyethylene resin iii) Goods 16 to be packed
Diameter of confectionery (drops):about 3 cm iv) Others
H:10 cm (FIG. 7)
H:35 cm (FIG. 8)
c:15 cm (FIG. 12)
m:15.5 Cm (FIG. 12)

What is claimed is:

1. A continuous packing apparatus comprising:

a cylindrical net supply source (20) for supplying a cylindrical long packing net (1);

a cylindrical net moving means for externally supporting the cylindrical net (1) supplied from said cylindrical net supply source (20) and for drawing an upper end of the cylindrical net (1) upward from said cylindrical net supply source (20), comprising:

a shuttle (2) to be inserted in the cylindrical net (1) so as to be vertically moved;

a lower support member (3) for externally supporting said shuttle (2) through the cylindrical net (1), said lower support member (3) having a central vertical aperture having a size and shape so that said shuttle (2) can be removably and tightly mounted therein from above; and a moving member for moving said lower support member (3) upward relative to said cylindrical net supply source (20);

a first clamp (5) for clamping the cylindrical net (1) below said cylindrical net moving means and above said cylindrical net supply source (20), said clamp (5) being operative to clamp the net (1) until said cylindrical net moving means has moved upward a fixed distance (h), thereby drawing the cylindrical net (1) downward;

an upper support member positioned above said cylindrical net moving means for grasping and supporting the upper end of the cylindrical net (1) when said lower support member (3) has moved to an upper position and for maintaining the upper end of the cylindrical net (1) in an open condition, said shuttle having a central vertical aperture into which said upper support member (3) fits when said lower support member (3) is in the upper position, wherein said upper support member comprises a cylindrical holder (4) having an outward circumferential flange (4*a*) formed on the lower end of said cylindrical holder (4), and a ring-shaped fitting (10) resiliently urging downward onto the outward circumferential flange (4*a*) for pressing and supporting the opening of the upper end of the cylindrical net against the outward circumferential flange (4*a*) when said shuttle moves out of said upper support member;

a net bag forming means positioned above said cylindrical net supply source (20) and below said upper support member for cutting the cylindrical net (1) to separate an upper portion of the cylindrical net (1) from a lower portion of the cylindrical net (1)

and for forming a net bag in the upper portion of the cylindrical net; and a hopper (15) insertable into the cylindrical long packing net (1) for inserting items to be packed into the open upper end of the net bag.

2. A continuous packing apparatus according to claim 1, wherein said net bag forming means comprises:

a second clamp (11) positioned below said upper support member and above said cylindrical net supply (20) for clamping and closing the cylindrical net (1) at a point below said lower support member (3) when said lower support member (3) has moved to the upper position; and a cutter (12) positioned below and proximate to said second clamp (11) for horizontally cutting the cylindrical net.

3. A continuous packing apparatus according to claim 2 further comprising a heater (13) positioned proximate to said cutter (12) for heating, melting and integrally solidifying the upper cut portion of the cylindrical net.

4. A continuous packing apparatus according to claim 1, wherein said moving member comprises a vertical rail (19), and an elevator (18) slidably mounted on said vertical rail (19).

5. A continuous packing apparatus according to claim 1, wherein the shuttle has a vertical cylindrical portion and an inverted conical portion which integrally extends downward from the vertical cylindrical portion.

* * * * *